US007009099B1

(12) United States Patent
Belli

(10) Patent No.: US 7,009,099 B1
(45) Date of Patent: Mar. 7, 2006

(54) DRUM COUNTERHOOP

(75) Inventor: Remo D. Belli, Valencia, CA (US)

(73) Assignee: Remo, Inc., Valencia, CA (US)

( * ) Notice: Subject to any disclaimer, the term of this patent is extended or adjusted under 35 U.S.C. 154(b) by 0 days.

(21) Appl. No.: 08/896,593

(22) Filed: Jul. 18, 1997

(51) Int. Cl.
*G10D 13/02* (2006.01)

(52) U.S. Cl. ..... 84/411 R
(58) Field of Classification Search ..... 84/411 R
See application file for complete search history.

(56) References Cited

U.S. PATENT DOCUMENTS 3,668,296 A * 6/1972 Criscuolo ..... 84/414
5,417,136 A * 5/1995 Kralik et al. ..... 84/411 R

* cited by examiner

*Primary Examiner*—William M. Shoop, Jr.
*Assistant Examiner*—Shih-yung Hsieh
(74) *Attorney, Agent, or Firm*—Rapkin, Gitlin & Beaumont; Larry F. Gitlin, Esq.

(57) ABSTRACT

A counterhoop formed by bonding a conventional flat shaped hoop with a resilient shell component comprised of a convex outer wall and a generally flat inner wall. The resilient begins as a liquid resin, which is poured into an annular mold. The metal counterhoop is inserted into the resin, and the cured resin is allowed to harden, forming a shell which is bonded to the counterhoop to create a unitary component. The inner and outer walls of the shell join at the top edge of the counterhoop, where the hoop abuts the outer surface of the drumshell. The device maintains and provides the requisite strength and shape of a conga drum counterhoop, which is necessary to sustain the proper tensioning of the drumhead while, concurrently providing the resilience to substantially eliminate the soreness and discomfort that usually results when the hands are constantly striking the drumhead in the act of playing the instrument.

5 Claims, 3 Drawing Sheets

FIG. 1
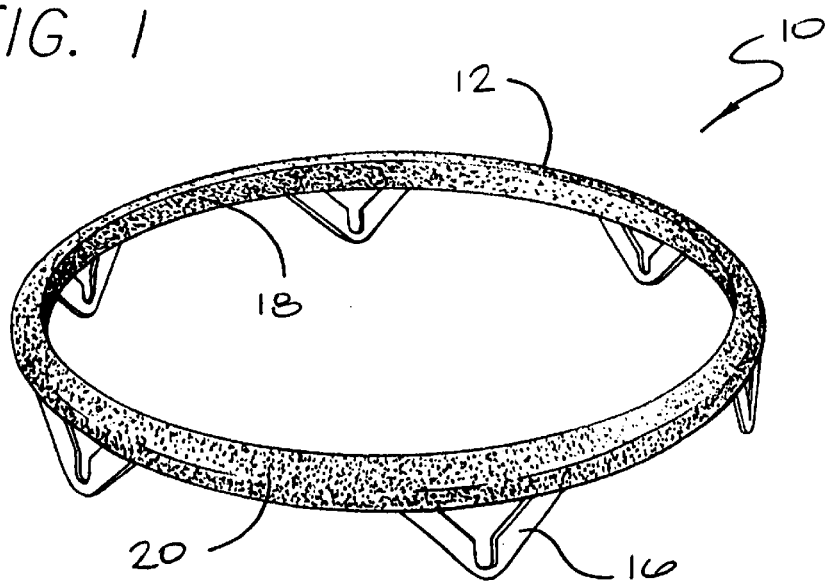
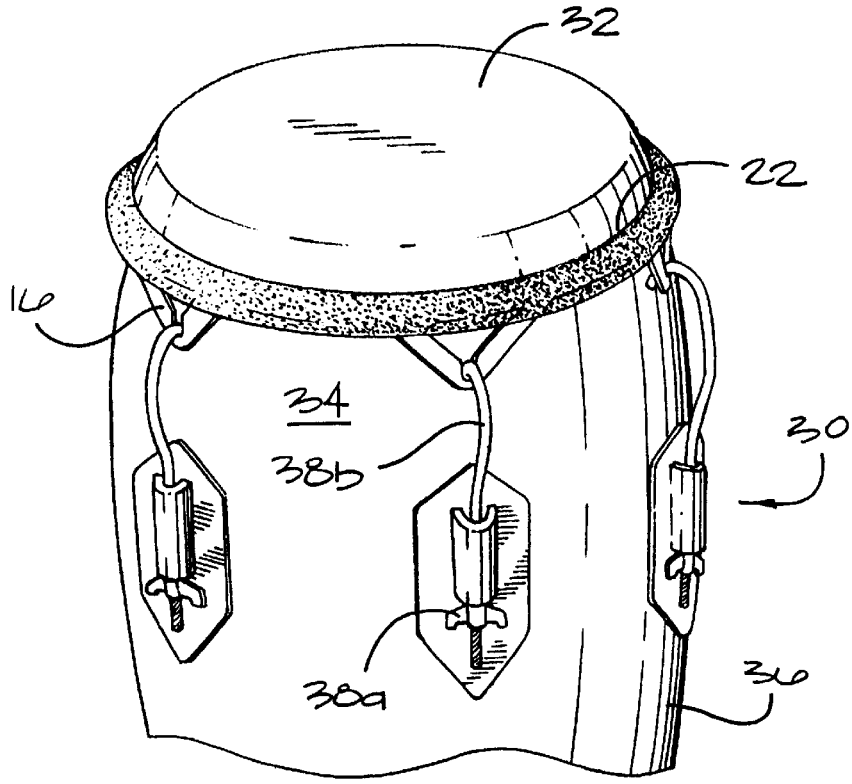
FIG. 2

DRUM COUNTERHOOP

BACKGROUND OF THE INVENTION

1. Field of the Invention

The present invention relates to the field of musical drums, and more particularly, to an improved counterhoop employed over a conga or a similar type of drumshell.

2. Description of the Prior Art

The conga drum, unlike most conventional types of drums, such as tom-toms and snares, is played by employing the hands to strike the drumhead at various points along its surface. In contrast, drumsticks are used to strike the batter head of a tom-tom or snare drum to produce the desired sound.

The origin of the drum generally dates back many thousands of years. The uniqueness of the conga drum lies in the use of the hands, more specifically the fingers, rather than sticks or mallets, to beat upon the drumhead to produce the sounds. However, the one significant drawback to playing a drum with the hands is the constant physical trauma the hands experience as a result of having to constantly beat upon the drumhead. More precisely, it is usually the palm portion and the back area of the hand adjacent to the fingers that will experience the greatest discomfort.

The use of rigid counterhoops in the construction of the modern conga drum, particularly the widely employed metal counterhoop, has created a problem which the present invention seeks to resolve. Generally, counterhoops used with congas are positioned around the drumshell below the surface of the drumhead. The counterhoop is positioned in this manner largely to remove it as an obstacle to the hands, which constantly beat upon the drumhead, particularly the perimeter areas of the head, to produce the drum sounds. If positioned like a counterhoop employed around the perimeter edges of a drumhead in the manner of those used with a conventional tom-tom or snare drum, the hoop would clearly interfere with the play of the instrument. Specifically, the hands, in an effort to beat upon the drumhead, would also be forced to strike the hoop, which is made of a much less forgiving material than the drumhead.

Even counterhoops that are positioned slightly below the surface of the drumhead continue to pose the same problem. Because of the location and movement of the hands when playing the conga, the palm portion of the hands are constantly striking the counterhoop, even when the hoop is positioned lower. Over time, the constant banging of the palms against the rigid counterhoop can cause severe pain and discomfort to the hands. Naturally, this will also interfere with the proper and effective playing of the instrument.

Certain efforts have been made to correct the problem. For example, attempts have been made to vary the shape of the counterhoop, i.e. give it a rounded or more curved exterior. Positioning the counterhoop at various locations along the side of the drumshell has also been tried. Even employing a flexible or more resilient material for the counterhoop, such as hardened rubber or some sort of polymer has been attempted. Yet, this softer and more resilient material does not provide the counterhoop the degree of rigidity and strength necessary to properly tension and maintain the tensioning of the drumhead.

In an effort to remedy this serious problem, an improved version of a counterhoop is formed employing a conventional flat shaped counterhoop set within a liquid resin which, when cured, forms a resilient shell around the hoop to which it bonds. The resilient shell has a flat inner wall and a convex or curved outer wall. The bonded components serve to provide the strength and rigidity required of a counterhoop to properly and effectively function and the resiliency and design to alleviate the obstacle and the discomfort to the hands that is normally associated with the playing of the instrument.

SUMMARY OF THE INVENTION

The present invention provides a counterhoop that is formed by bonding a conventional flat shaped hoop, which includes tension brackets, with a resilient polymer shell. The polymer shell is comprised of a convex outer wall and a generally flat inner wall.

The resilient shell begins as a liquid resin, which is poured into an annular mold. The metal counterhoop is inserted into the resin, and the cured resin is allowed to harden, forming a shell which is bonded to the counterhoop to create a unitary component. The resilient shell is essentially two-sided, with a generally flat inner surface and a curved or convex outer surface. The two surfaces meet at the top edge of the device, which abuts the outer surface of the drumshell.

Thus, the present invention comprises a device that maintains the strength and shape of a conga drum counterhoop, which is necessary to sustain the proper tensioning of the drumhead while, at the same time, providing the resilience to minimize, if not totally eliminate, the soreness and discomfort usually resulting from the hand constantly striking the drumhead.

Accordingly, it is the object of the present invention to provide an improved counterhoop for a conga drum.

Another object of the present invention is to provide an improved counterhoop formed within a resilient shell to protect the drummer's hands from the pain and soreness that usually accompanies the constant striking of the hands upon the drumhead.

A further object of the present invention is to provide an improved counterhoop with a bonded resilient shell component that maintains the shape and strength required to sustain the proper tensioning of the drumhead.

A still further object of the present invention is to provide an improved counterhoop that will maintain its uniformity of shape and structural integrity over time.

A still further object of the present invention is to provide an improved counterhoop that is easy and economical to manufacture.

These and other objects and advantages of the present invention will become apparent in the following specifications when considered in light of the attached drawings wherein the preferred embodiment of the invention is illustrated.

BRIEF DESCRIPTION OF THE DRAWINGS

FIG. 1 is a perspective view of the counterhoop of the present invention.

FIG. 2 is a view of the counterhoop of the present invention shown employed on a conventional conga drumshell.

DETAILED DESCRIPTION OF THE PREFERRED EMBODIMENT

Figure 3:
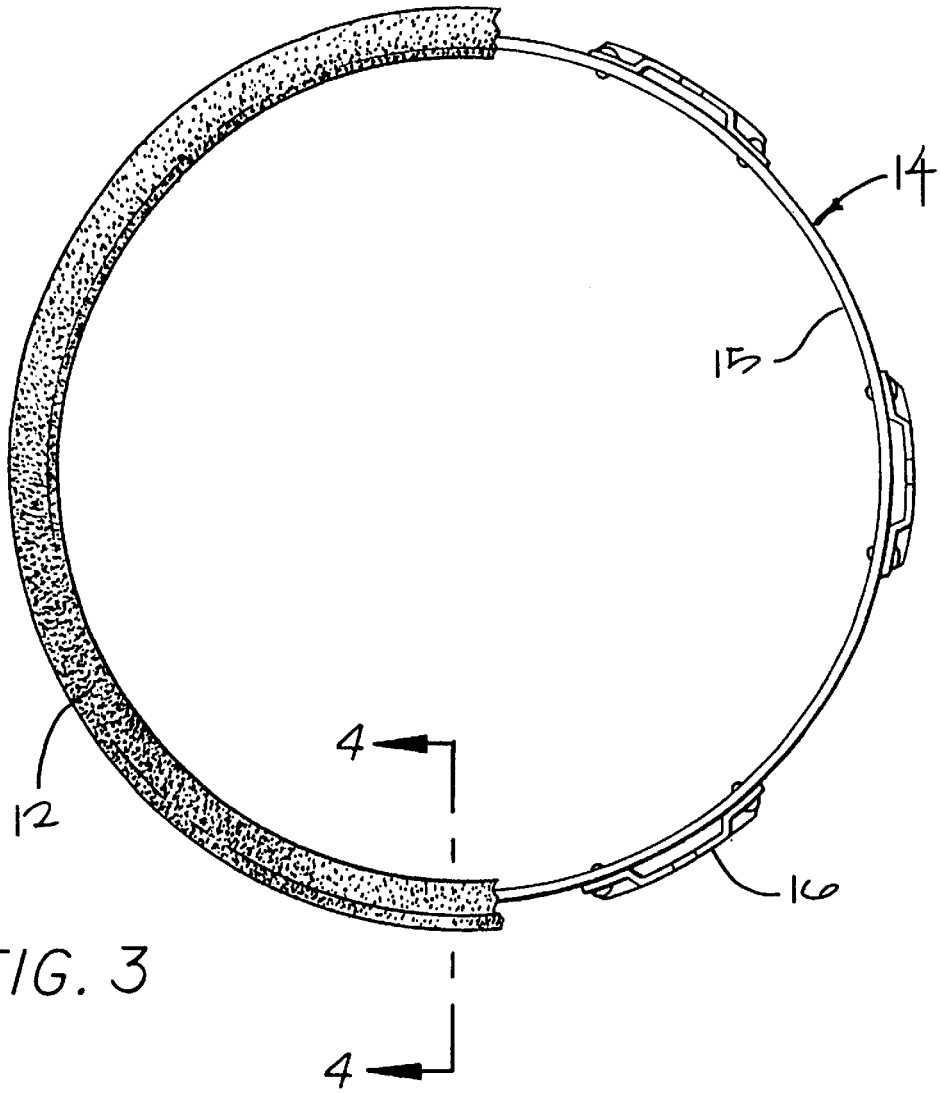
FIG. 3 is a cutaway view of the counterhoop of the present invention showing the metal counterhoop component within.
Figure 4:
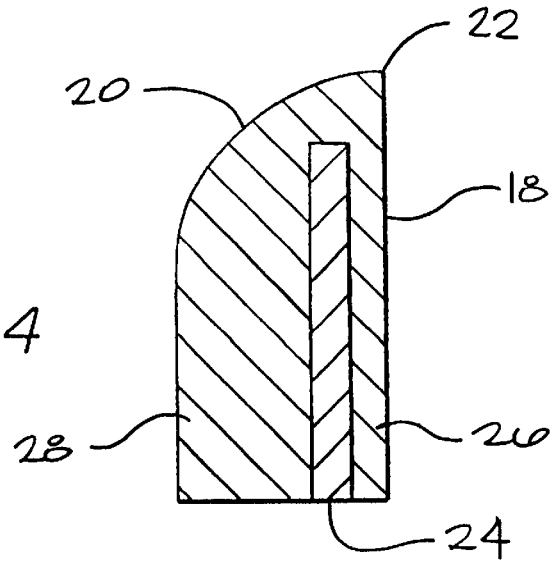
FIG. 4 is a view of the counterhoop of the present invention shown along lines 4—4 of FIG. 3.
Figure 5:
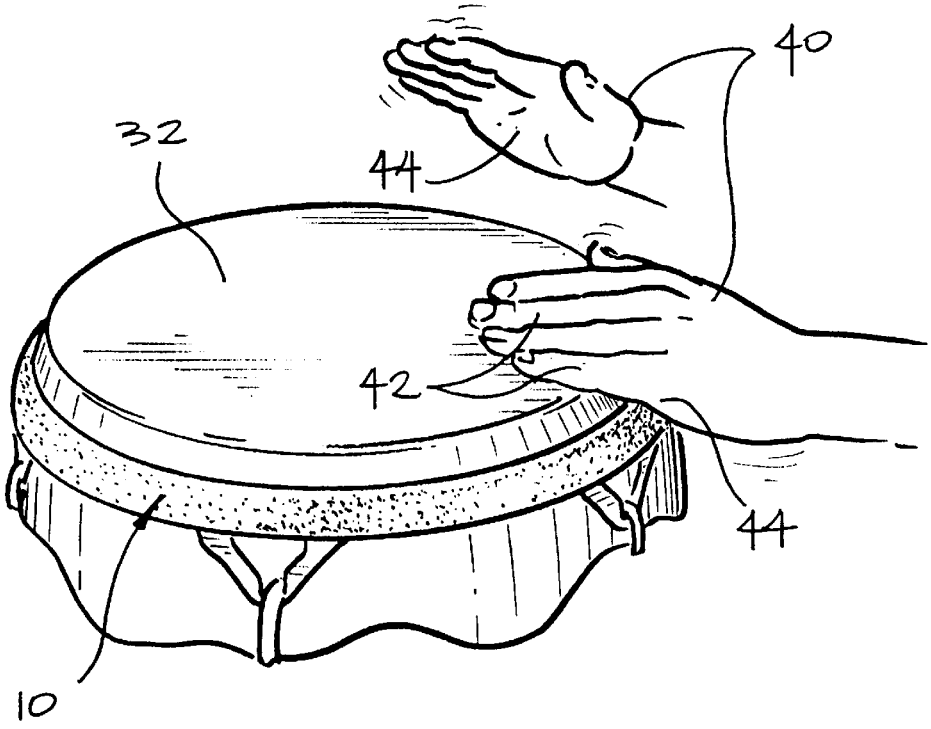
FIG. 5 is a view of a percussionist's hands in the act of playing the conga.

FIG. 1 shows a drum counterhoop 10 having an outer shell 12 and an inner hoop 14, which includes a ring 15 and a plurality of tension brackets 16. Outer shell 12 is produced from any suitable resin material that begins in liquid form and ultimately will harden. Outer shell 12 includes a generally flat inner wall 18 and a curved or convex outer wall 20, which join together in a unitary fashion along edge 22. Edge 24 of hoop 14 is exposed at the bottom. Ring 15 is sandwiched between and bonded to sidewall members 26, 28 of outer shell 12.

Inner hoop 14 is typically made of a metal alloy to give it the necessary strength to properly and effectively tension a drumhead. Edge 24 is approximately ¼" in thickness. Ring 15 is approximately ¾" in height. The thickness of flat inner wall 18 is approximately ⅛" and the thickness of the convex outer wall 20 is approximately ¼". Depending upon a variety of factors, these dimensions may vary.

As shown in FIG. 2, where a typical conga drum 30 is represented, the counterhoop 10 is placed over and then situated below drumhead 32, where it is fixed tightly against outer sidewall 34 of the conga drumshell 36. Lug nut 38*a* and coordinating hook 38*b* are connected to tension brackets 16 and tightened to tension the drumhead 32 to the proper tonality. In this position, the flat inner wall 18 and edge 22 securely abut the conga outer sidewall 34 and convex sidewall 20 is exposed.

Unlike a conventional tom-tom or snare drum, where drumsticks or brushes are employed to strike the batter head 32, a conga drum is normally played with the hands 40. Specifically, the conga sound is produced by striking the batter head 32 largely with the fingers 42 and a portion of the palms 44. As the fingers 42 are striking the batter head 32, the portion of the hands 40 that are not striking the drumhead are likely striking the counterhoop 10. This repetitive contact between the hands 40 and a conventional counterhoop is likely to cause the hands in the area affected some substantial soreness and discomfort over time. Naturally, this will affect the play of the instrument. Employing the device of the present invention alleviates this problem.

While the invention will be described in connection with a certain preferred embodiment, it is to be understood that it is not intended to limit the invention to that particular embodiment. Rather, it is intended to cover all alternatives, modifications and equivalents as may be included within the spirit and scope of the invention as defined by the appended claims.

What is claimed is:

1. A counterhoop for use in fixedly securing a drumhead to a drumshell and tensioning said drumhead, comprising:

means having a liquid state curable to a rigid state;

a ring member set in a position within the liquid state of said means and maintained in said position until said means cures to a rigid state and forms a resilient shell bonded to the ring member, said resilient shell comprising a convex outer wall and a generally flat inner wall that converge to form an edge, said flat inner wall and said edge abut the drumshell;

said joined ring member and said resilient shell being disposed over said drumhead and circumferentially around the drumshell to tension the head and secure it to the drumshell.

2. The invention of claim 1 wherein the joined ring member and resilient shell are disposed circumferentially around the drumshell at a position on the drumshell below the drumhead.

3. The invention of claim 1 wherein the edge that abuts the drumshell is generally rounded.

4. The invention of claim 1 wherein said ring member includes a plurality of tension brackets.

5. A counterhoop for use in fixedly securing a drumhead to a drumshell and tensioning said drumhead, comprising:

a ring member;

a resilient shell formed substantially around and bonded to the ring member, said resilient shell having a convex outer wall and a generally flat inner wall, said outer and inner walls converging to form an edge that abuts the drumshell.

* * * * *